US005378184A

United States Patent [19]

Bro et al.

[11] Patent Number: 5,378,184

[45] Date of Patent: Jan. 3, 1995

[54] TOY FIGURE HAVING DISASSEMBLEABLE APPENDAGES

[75] Inventors: Jay M. Bro; Philip M. Baerenwald, both of Plano, Tex.

[73] Assignee: Today's Kids, Inc., Booneville, Ark.

[21] Appl. No.: 14,130

[22] Filed: Feb. 5, 1993

[51] Int. Cl.[6] ..... A63H 3/16; A63H 3/12; A63F 9/10; G09B 19/00

[52] U.S. Cl. ..... 446/99; 446/321; 434/259; 273/157 R

[58] Field of Search ..... 446/97, 99, 100, 101, 446/117, 268, 321, 337, 376, 384, 390; 434/259, 258; 273/156, 157

[56] References Cited

U.S. PATENT DOCUMENTS

| | | | |
|---|---|---|---|
| 858,090 | 6/1907 | Meinecke | 446/99 |
| 1,211,590 | 9/1917 | Kennedy . | |
| 1,460,700 | 7/1923 | Buffington | 446/101 X |
| 1,649,135 | 11/1927 | Shasteen | 446/101 |
| 2,386,853 | 10/1945 | Herrmann . | |
| 2,911,740 | 11/1959 | Miller | 434/259 |
| 3,375,604 | 4/1968 | Alonso . | |
| 3,510,964 | 5/1970 | Dahners et al. | 434/259 X |
| 3,545,798 | 12/1970 | Swett . | |
| 3,674,264 | 7/1972 | Boercker | 434/258 X |
| 3,685,201 | 8/1972 | Drieze . | |
| 3,982,353 | 9/1976 | Christiansen . | |
| 4,008,526 | 2/1977 | Swett et al. . | |
| 4,215,509 | 8/1980 | Mariol . | |
| 4,286,952 | 9/1981 | Roche | 273/156 X |
| 4,508,512 | 4/1985 | Girsch et al. | 434/259 |
| 4,579,538 | 4/1986 | Bass et al. | 446/97 X |
| 4,581,904 | 4/1986 | Lehmann . | |
| 4,698,023 | 10/1987 | Marino . | |
| 4,869,701 | 9/1989 | Kawai et al. | 434/259 X |
| 5,139,453 | 8/1992 | Aiken et al. | 434/259 X |

FOREIGN PATENT DOCUMENTS

| | | | |
|---|---|---|---|
| 753029 | 10/1933 | France | 446/97 |
| 1259946 | 3/1961 | France | 446/97 |
| 2229168 | 5/1973 | Germany | 434/259 |
| 2133712 | 8/1984 | United Kingdom | 446/101 |

OTHER PUBLICATIONS

Copy of p. 860 of Official Gazette dated Nov. 28, 1926, illustrating statuette to Studdy.

*Primary Examiner*—Robert A. Hafer
*Assistant Examiner*—D. Neal Muir
*Attorney, Agent, or Firm*—Kirkpatrick & Lockhart

[57] ABSTRACT

A toy figure having disassembleable appendages attached thereto. The figure includes a body member that has a plurality of receptacles therein adapted to removably receive therein extended connection members that are attached to the appendages. Each extended member preferably has a cross-sectional shape, number, and color that differs from the cross-sectional shapes, numbers, and colors of the other extended members. Each receptacle is configured to receive at least one of the extended members therein and is also preferably provided with a number and color that corresponds to the number and color of the extended member that is adapted to be received therein. Each appendage is also preferably provided with shape, number, and color indicators that serve to identify the cross-sectional shape, number, and color of the extended member that is attached thereto.

32 Claims, 15 Drawing Sheets

TOY FIGURE HAVING DISASSEMBLEABLE APPENDAGES

BACKGROUND OF THE INVENTION

1. Field of Invention

The present invention relates to toy figures and, more particularly, is directed to toy figures having disassembleable appendages.

2. Description of the Invention Background

Perhaps it is every parent's desire to provide his or her child with a toy that is not only entertaining and fun to play with but also serves to educate the child or further develop one or more of the child's physical abilities or skills. For example, interactive video games have been found to improve a child's hand-to-eye coordination. Jigsaw puzzles can improve a child's ability to recognize and associate shapes. Those toys, however, are primarily directed to older children and are not well adapted for use by toddlers and infants.

Traditional toddler toys, such as stuffed animals and the like, typically only function as cuddly playmates for the child and lack attributes for advancing the development of the child's physical and psychological abilities and skills. However, a number of other toys do exist that are designed to provide a medium through which a child can develop and improve his or her muscular dexterity and coordination. For example, U.S. Pat. No. 3,545,798 to Swett discloses a toy animal figure that includes a central torso section that has removable appendages attached thereto. The removable appendages are designed such that a meaningful amount of force is necessary to dislodge the pieces in relationship to each other so they will not be accidentally dissembled when they are handled by a child.

Other toys are designed to function as shape identification and association devices for children. For example, U.S. Pat. No. 4,008,526 to Swett et al. discloses a hollow ball-shaped member that has a plurality of differently shaped openings therein that are adapted to receive correspondingly shaped block members therethrough. Another shape-matching toy is disclosed in U.S. Pat. No. 1,211,590 to Kennedy. That patent discloses animal figures having planar torso sections with planar appendages removably attached thereto. Each appendage is equipped with an attachment member that is adapted to be received in a correspondingly shaped socket or sockets located in a variety of differently shaped torso members.

None of the toys described above, however, can function as a cuddly playmate for the child while also providing a means whereby an infant or toddler can develop and improve his or her muscular coordination and dexterity while also advancing his or her shape, color, and number identification and association skills. As such, there is a need for a toy that is cuddly and capable of safe assembly and disassembly by a toddler or infant that also provides a means for developing the child's shape, number, and color identification skills.

SUMMARY OF THE INVENTION

In accordance with the particular preferred form of the present invention, there is provided a toy figure that comprises a body member that has a plurality of appendages that are removably connectable to the body member in a variety of orientations. The toy figure also includes means for connecting the appendages to the body member which preferably comprises an extended member that is attached to each of the appendages. Each extended member is different from the other extended members and is adapted to be received in at least one of a plurality of receptacles provided in the body member.

It is an object of the present invention to provide a toy figure that is cuddly and capable of being carried by an infant or toddler.

It is another object of the present invention to provide a toy figure that has removable appendages that are attached to a body member such that they may be detached and reattached to the body in a variety of different orientations.

Another object of the present invention is to provide a disassembleable toy that can develop a child's muscular dexterity and coordination.

It is yet another object of the present invention to provide a toy that can foster an infant's or toddler's ability to recognize and associate different shapes, numbers, and colors.

Accordingly, the preferred form of the present invention provides a unique toy playmate for toddlers and infants that is cuddly and serves to provide a means through which the child can develop his or her muscular dexterity and shape, number, and color recognition and association skills. The reader will readily appreciate that these and other details, objects and advantages will become apparent as the following detailed description of the present preferred embodiment thereof proceeds.

BRIEF DESCRIPTION OF THE DRAWINGS

In the accompanying drawings, we have shown a present preferred embodiment of the invention wherein like reference numerals are employed to designate like parts and wherein.

DETAILED DESCRIPTION OF THE PREFERRED EMBODIMENTS

Figure 1:
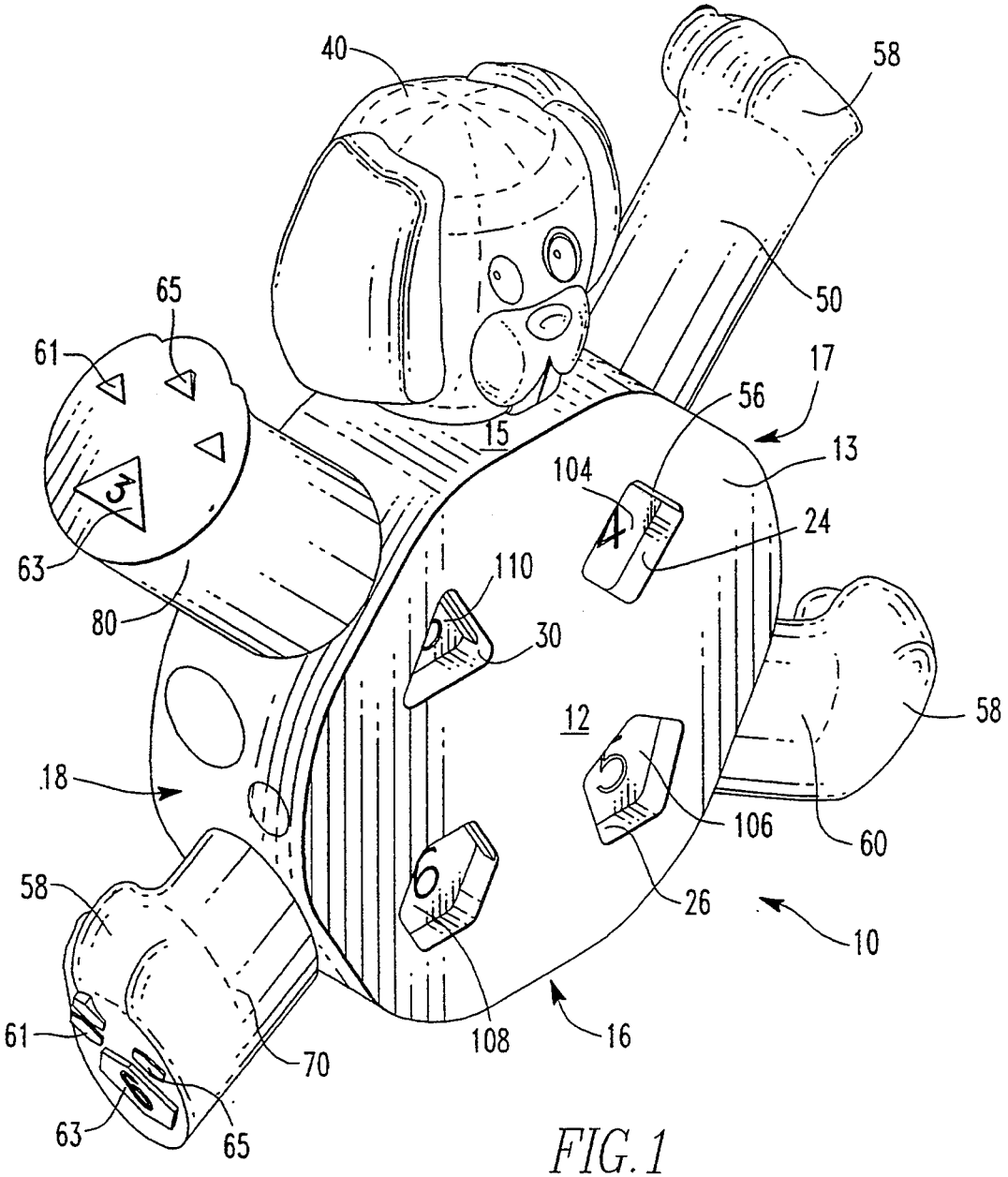
FIG. 1 is a perspective view of the toy puppy figure of the present invention in a first pose.

Referring now to the drawings for the purposes of illustrating the present preferred embodiment of the invention only and not for purposes of limiting the same, the Figures show a toy puppy figure generally designated as 10 that consists of a body member 12 that has a collection of appendages removably attached thereto. The skilled artisan will, of course, appreciate that the present invention may be provided in a variety of different human-like or animal-like figures that also have removable appendages attached thereto. It will also be appreciated that the present invention may comprise a variety of different non-human or non-animal like figures such as robots or human-animal hybrid creatures without departing from the principal and scope of the present invention.

Figure 10:
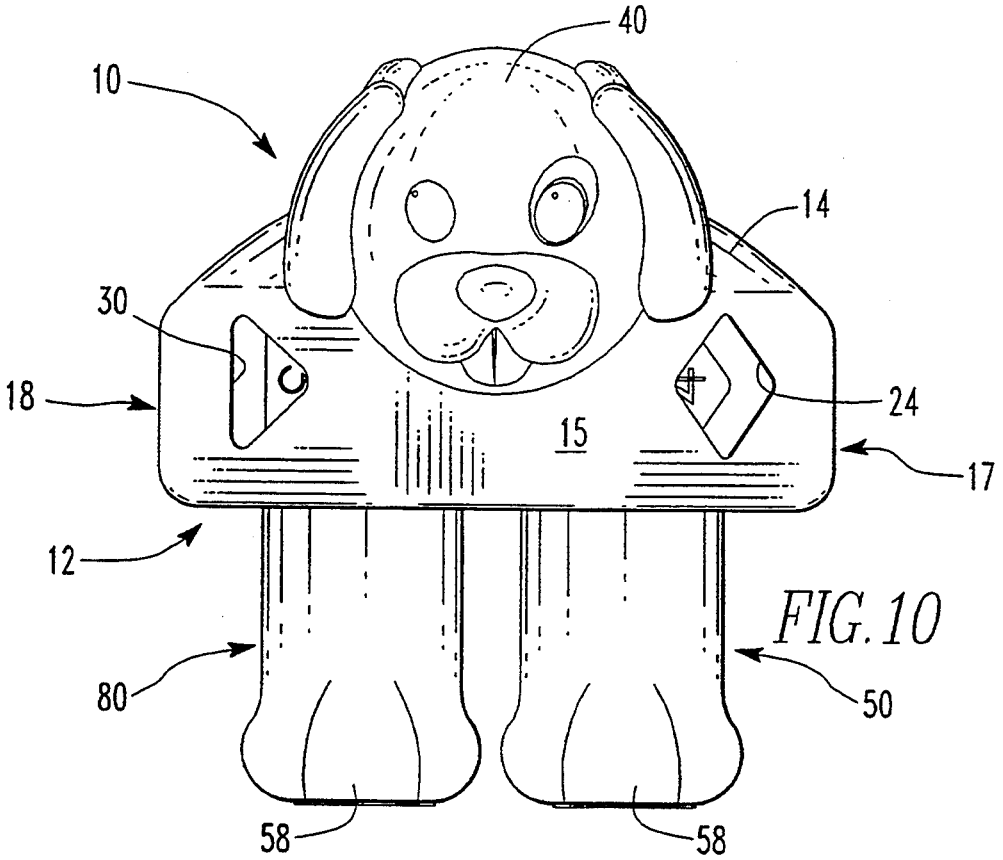
FIG. 10 is a top view of the toy puppy figure of FIG. 8.

More particularly and with reference to FIGS. 1–7, there is shown a toy puppy FIG. 10 that includes a body member 12 that has a head member 40, a leg member 50, a leg member 60, a leg member 70, a leg member 80, and a tail member 90 removably attached thereto. In the preferred embodiment, the components of the puppy FIG. 10 are hollow and are molded from polyvinyl chloride by known manufacturing techniques. However, the puppy FIG. 10 may be fabricated from a variety of other materials, including those that are non-toxic and capable of being safely handled by infants and toddlers.

Figure 2:
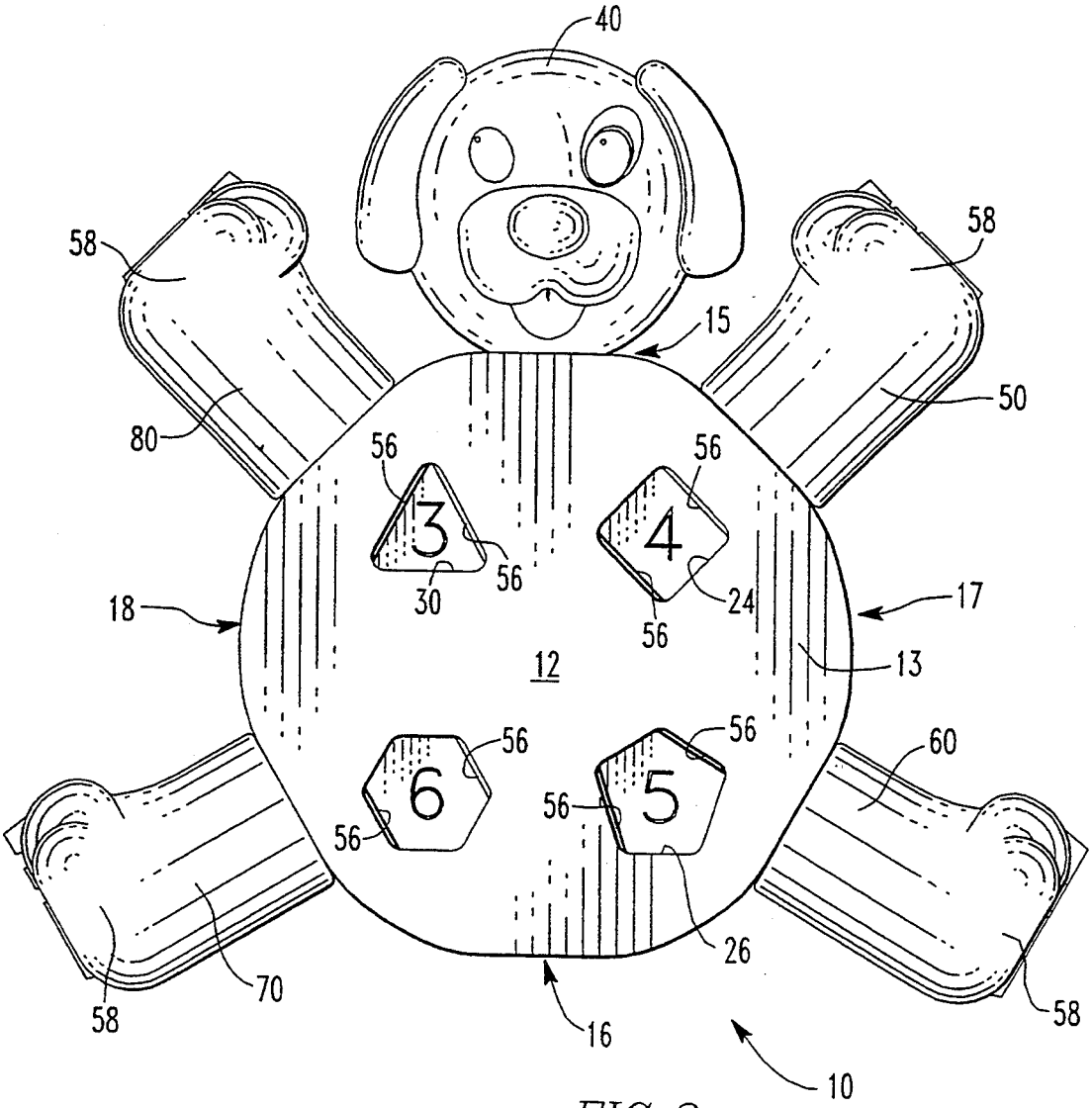
FIG. 2 is a front elevational view of the toy puppy figure of FIG. 1.
Figure 5:
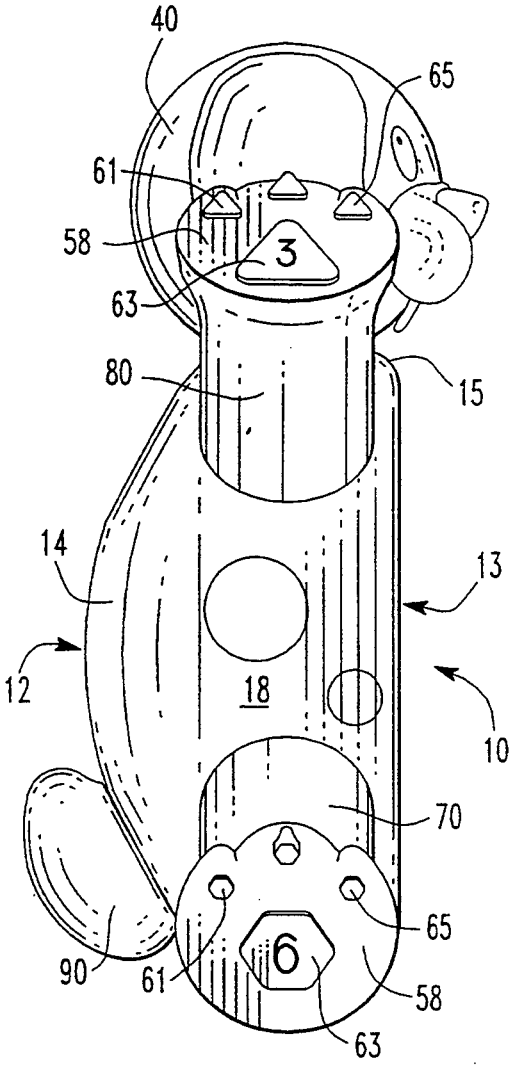
FIG. 5 is a left side elevational view of the toy puppy figure of FIG. 1.
Figure 4:
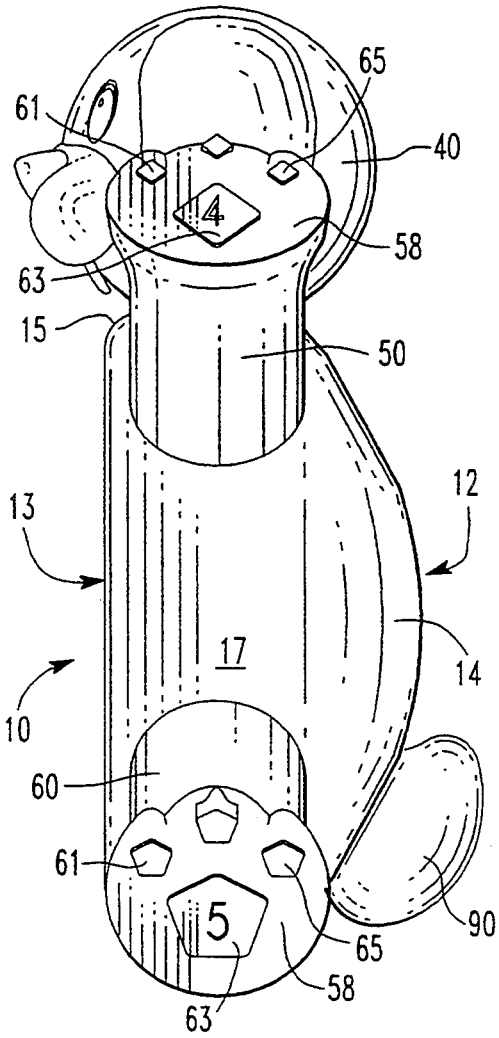
FIG. 4 is a right side elevational view of the toy puppy figure of FIG. 1.
Figure 6:
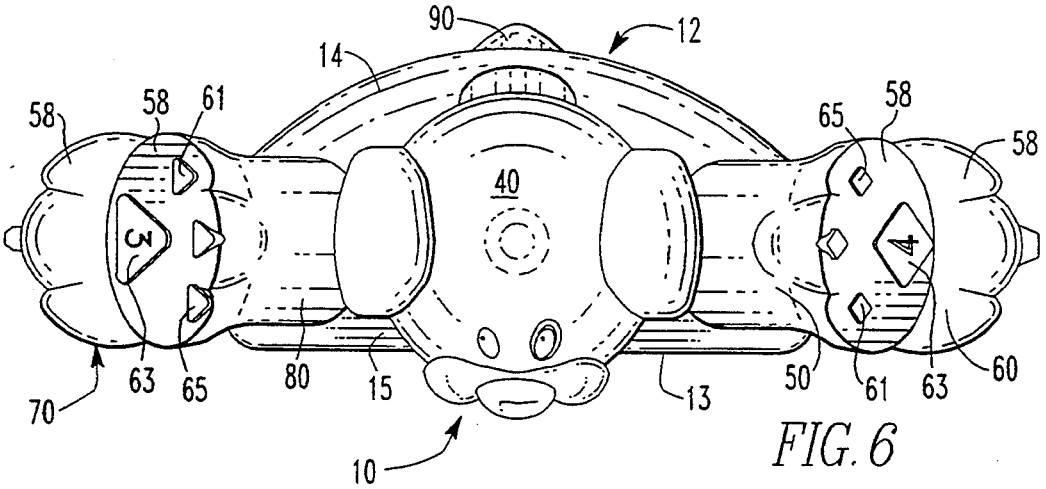
FIG. 6 is a top view of the toy puppy figure of FIG. 1.
Figure 7:
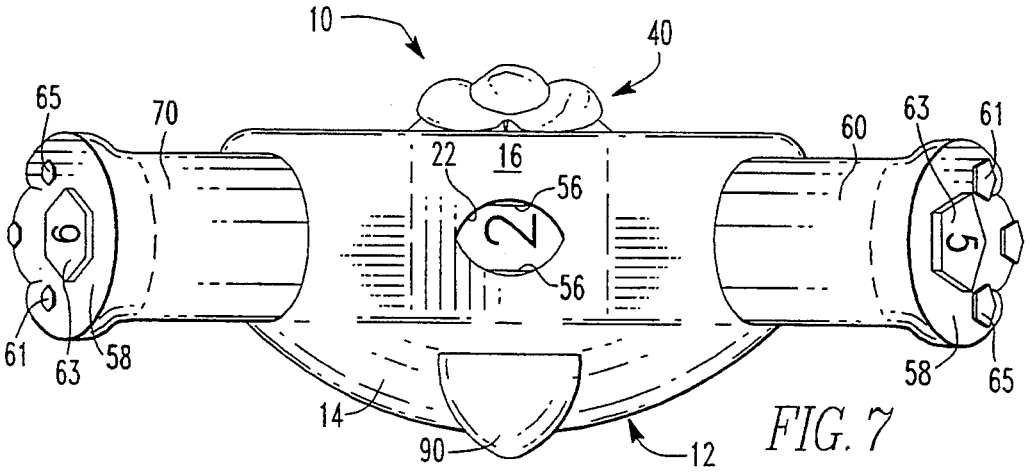
FIG. 7 is a bottom view of the toy puppy figure of FIG. 1.

As most particularly, shown in FIGS. 2, 4, and 5, the body member 12 preferably has a flat front portion 13, an arcuate back portion 14, a top portion 15, a bottom portion 16, a right side 17 and a left side 18. It will be appreciated by those of ordinary skill in the art, however, that the body member 12 may be provided in a myriad of other different shapes and configurations.

Figure 3:
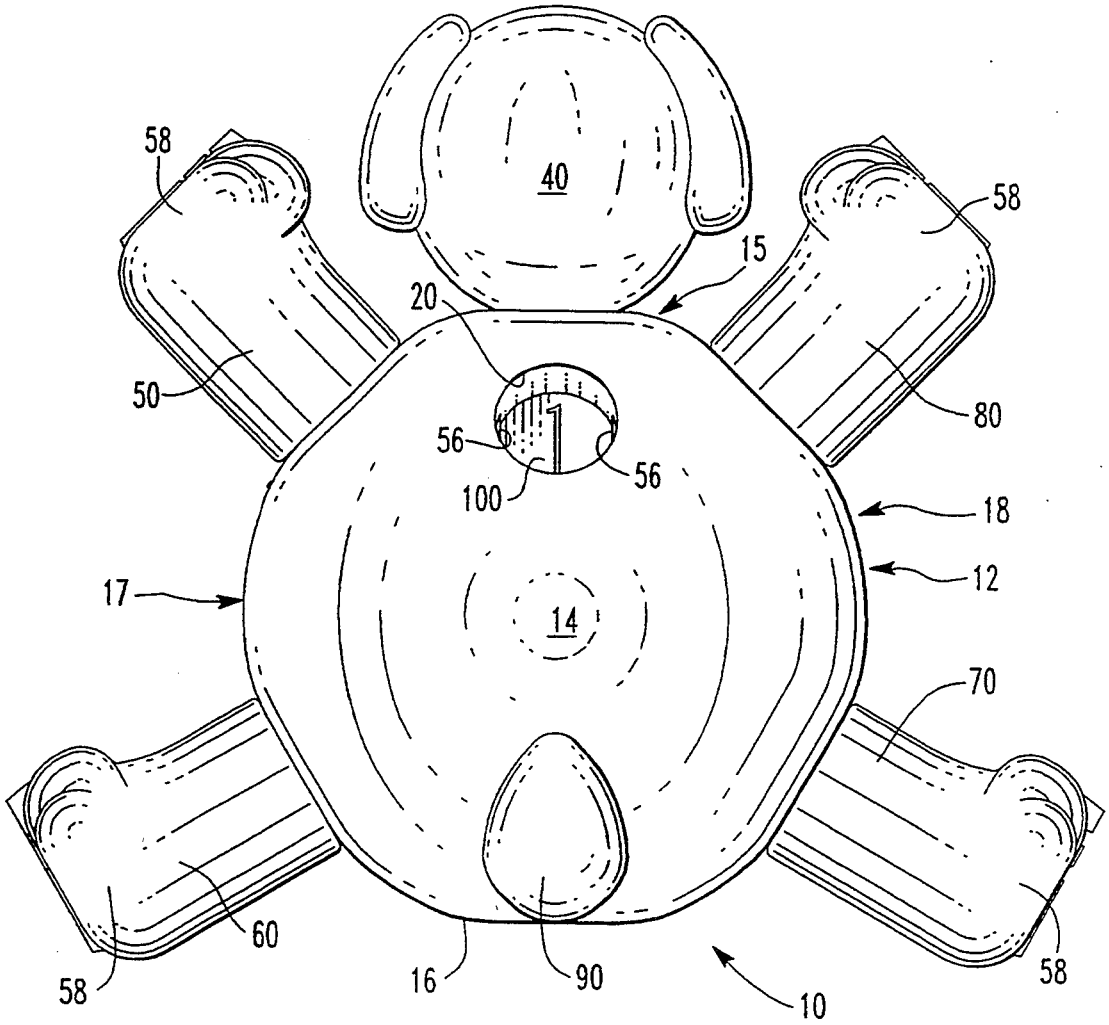
FIG. 3 is a rear elevational view of the toy Puppy figure of FIG. 1.
Figure 8:
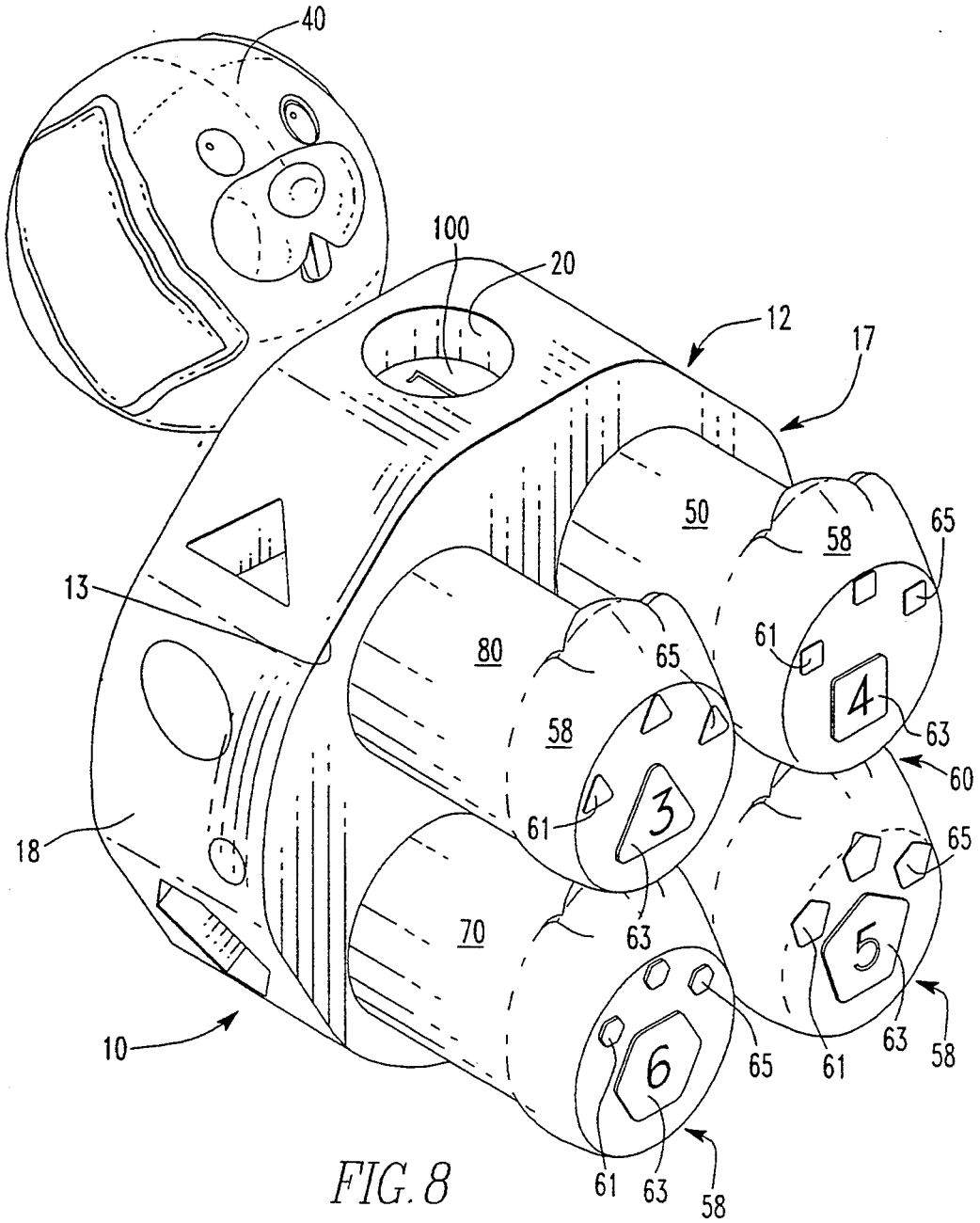
FIG. 8 is a perspective view of the toy puppy figure of the present invention in a second pose.
Figure 9:
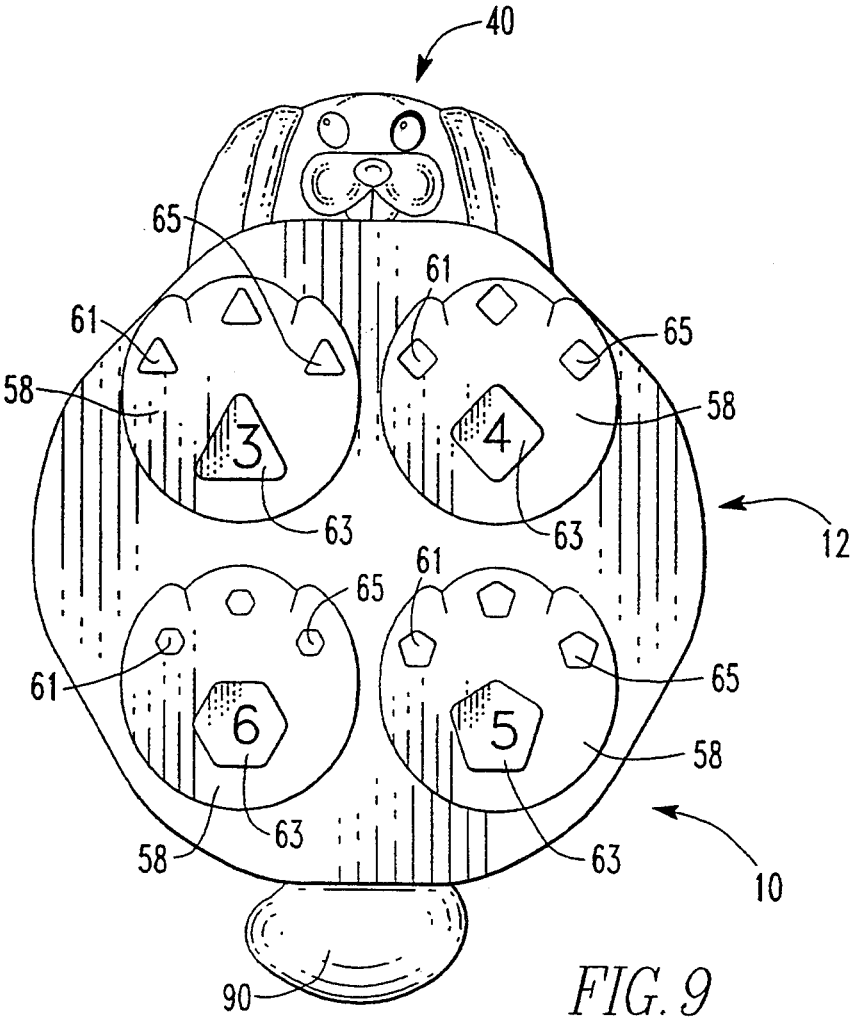
FIG. 9 is a front elevational view of the toy puppy of FIG. 8.

In general, the various appendages described above are preferably attached to the body member 12 via a collection of receptacles located in various portions of the body member 12. More specifically, the head member 40 can be attached to the body member 12 at two different locations defined by circular-shaped receptacles 20 as shown in FIGS. 3 and 8. In particular, the head member 40 is removably attached to the body member 12 by virtue of engagement between one of the receptacles 20 and an extended member 42 that is attached to the head member 40. See FIGS. 15 and 16. Extended member 42 has a circular cross-sectional shape and is adapted to be slidably received in either of the receptacles 20.

In addition, as illustrated in FIGS. 7, 11, 17, and 18, the body member 12 is preferably provided with two oval or football shaped receptacles 22 that are adapted to slidably receive a similarly shaped extended connection member 92 that is attached to the tail member 90. It will be understood that such connection arrangement permits the tail member 90 to be attached to the body member 12 in four different orientations.

Figure 13:
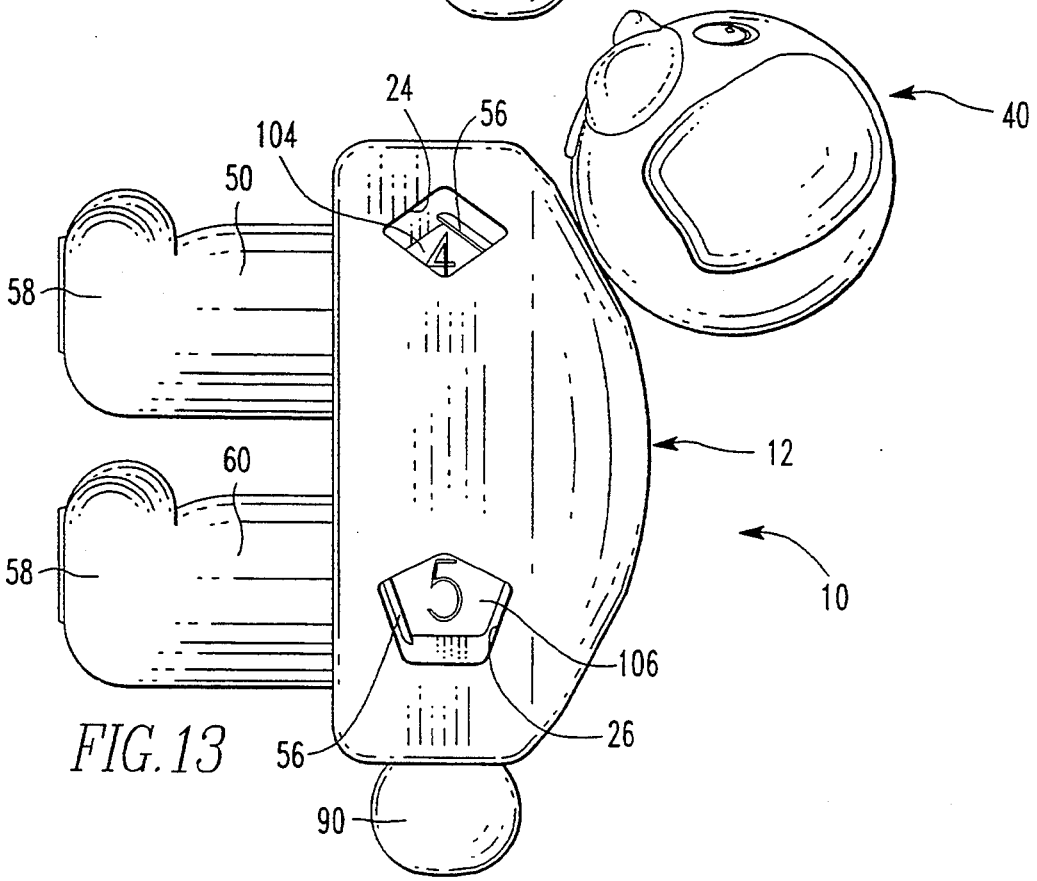
FIG. 13 is a right side elevational view of the toy puppy figure of FIG. 8.

The four leg members 50, 60, 70, and 80 are also removably attached to the body member 12 by a similar arrangement of uniquely shaped receptacles and connection members. In particular, as shown in FIGS. 2, 10, and 13, two square-shaped receptacles 24 are provided in the body member 12 that are adapted to slidably receive therein a square-shaped extended connection member 52 that is attached to the leg member 50. See FIGS. 19 and 20. As such, in the preferred embodiment, the leg member 50 can be attached to the body member 12 by inserting the extended connection member 52 into one of the receptacles 24.

Figure 11:
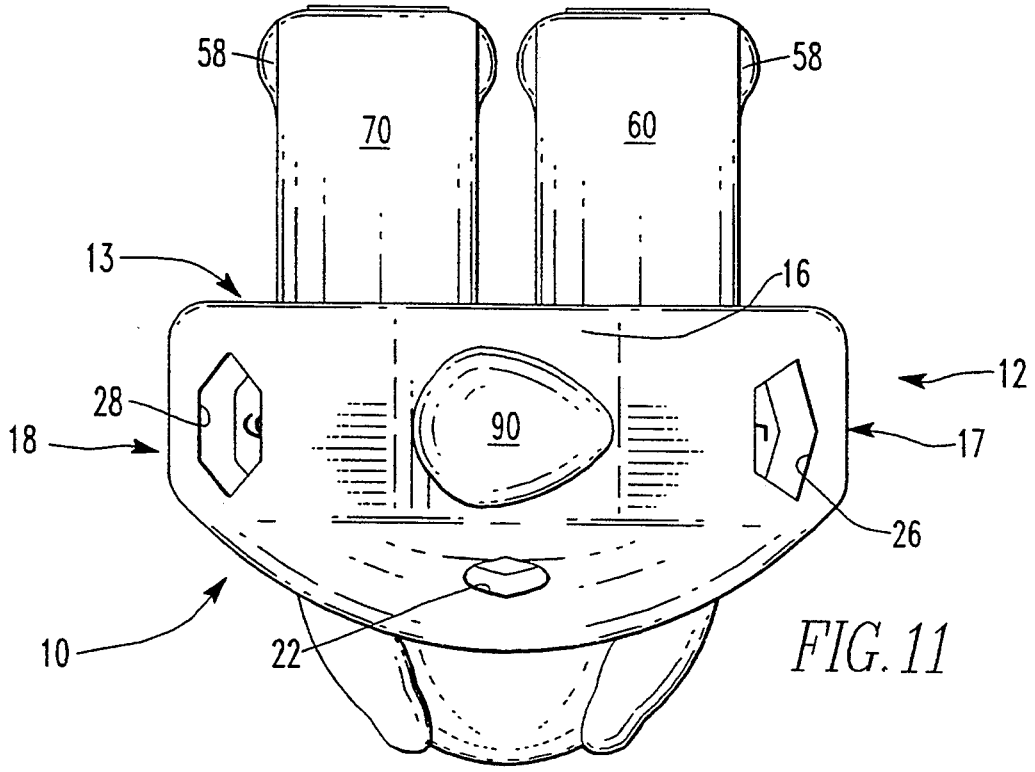
FIG. 11 is a bottom view of the toy puppy figure of FIG. 8.
Figure 12:
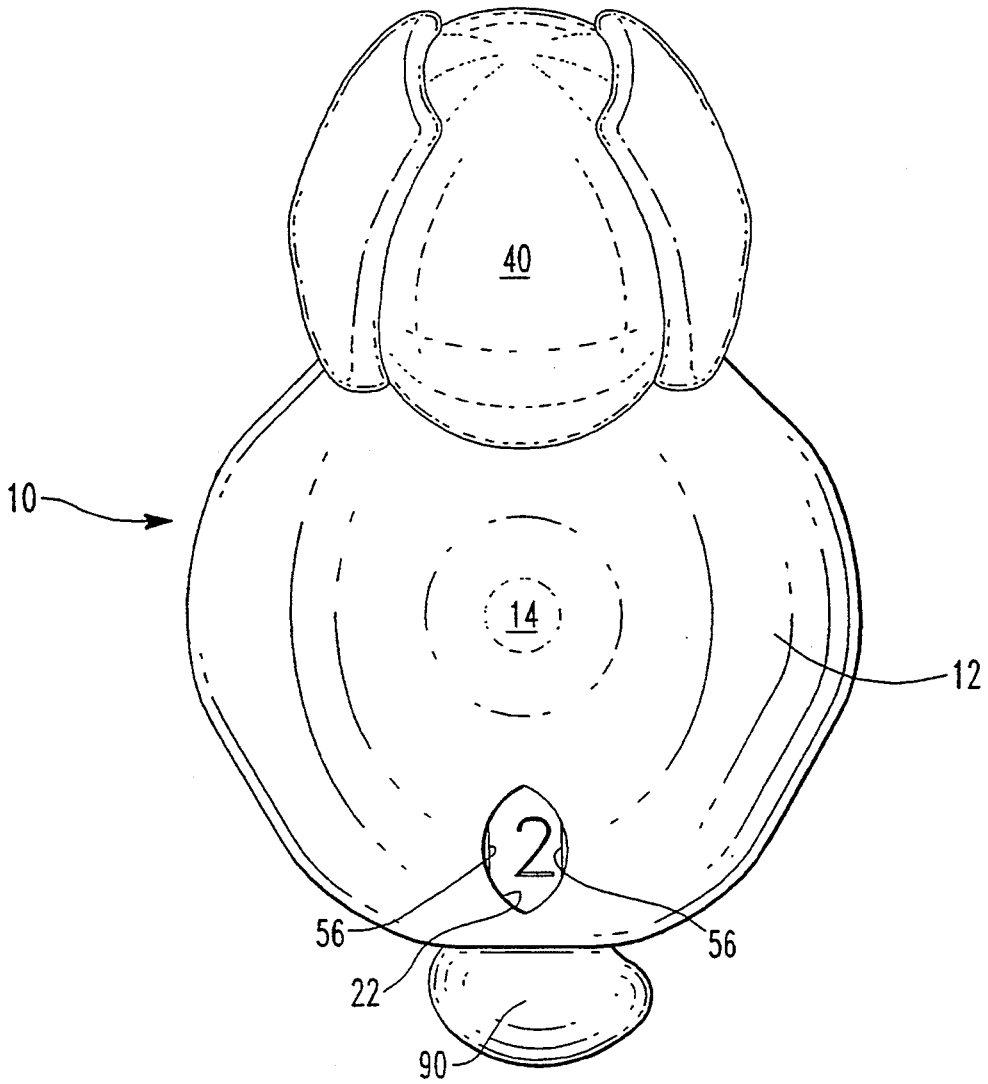
FIG. 12 is a rear elevational view of the toy puppy figure of FIG. 8.
Figure 23:
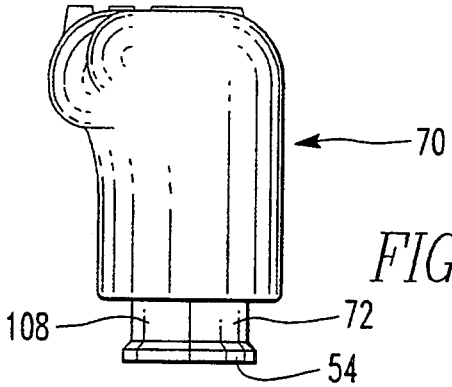
FIG. 23 is a side elevational view of a third leg member of the toy puppy figure of the present invention.
Figure 24:
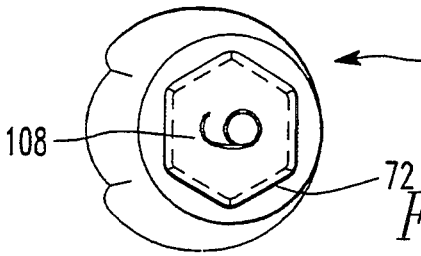
FIG. 24 is a bottom view of the leg member of FIG. 23.
Figure 25:
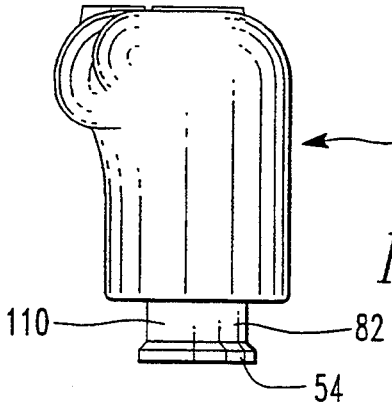
FIG. 25 is a side elevational view of a fourth leg member of the toy puppy figure of the present invention.
Figure 26:
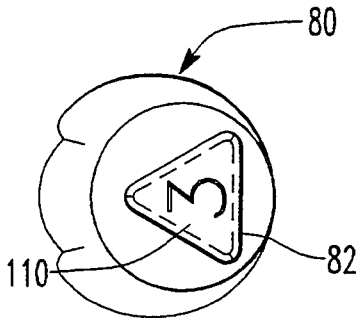
FIG. 26 is a bottom view of the leg member of FIG. 25.

As can be seen in FIGS. 1, 13, 21, and 22, the leg member 60 is preferably equipped with a pentagonal-shaped extended connection member 62 that is adapted to be slidably inserted into either of the pentagonal shaped receptacles 26 located in the body member 12. Leg member 70 also has an extended member 72 attached thereto that preferably has a hexagonal cross-sectional shape. See FIGS. 23 and 24. Extended member 72 of the leg member 70 is adapted to be slidably received in either of two hexagonal-shaped receptacles 28 that are located in body member 12 as illustrated in FIGS. 1 and 11. Likewise, leg member 80 is preferably equipped with an extended connection member 82 that has a triangular cross-sectional shape. See FIGS. 25 and 26. The extended member 82 is adapted to be slidably received in triangular-shaped receptacles 30 that are located in the body member 12 as shown in FIGS. 1 and 10.

Those of ordinary skill in the art will readily appreciate that the above described arrangement will permit each of the appendages (i.e., the head member 40, the tail member 90, and the leg members 50, 60, 70, and 80) to each be attached to the body member 12 at two different locations. It will further be understood that the various above-described receptacles and their corresponding connection members may be provided in a variety of different shapes, quantities, and arrangements without departing from the principle and scope of the present invention.

Figure 19:
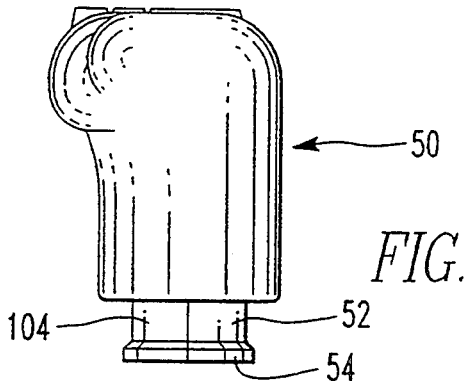
FIG. 19 is a side elevational view of a leg member of the toy puppy figure of the present invention.
Figure 27:
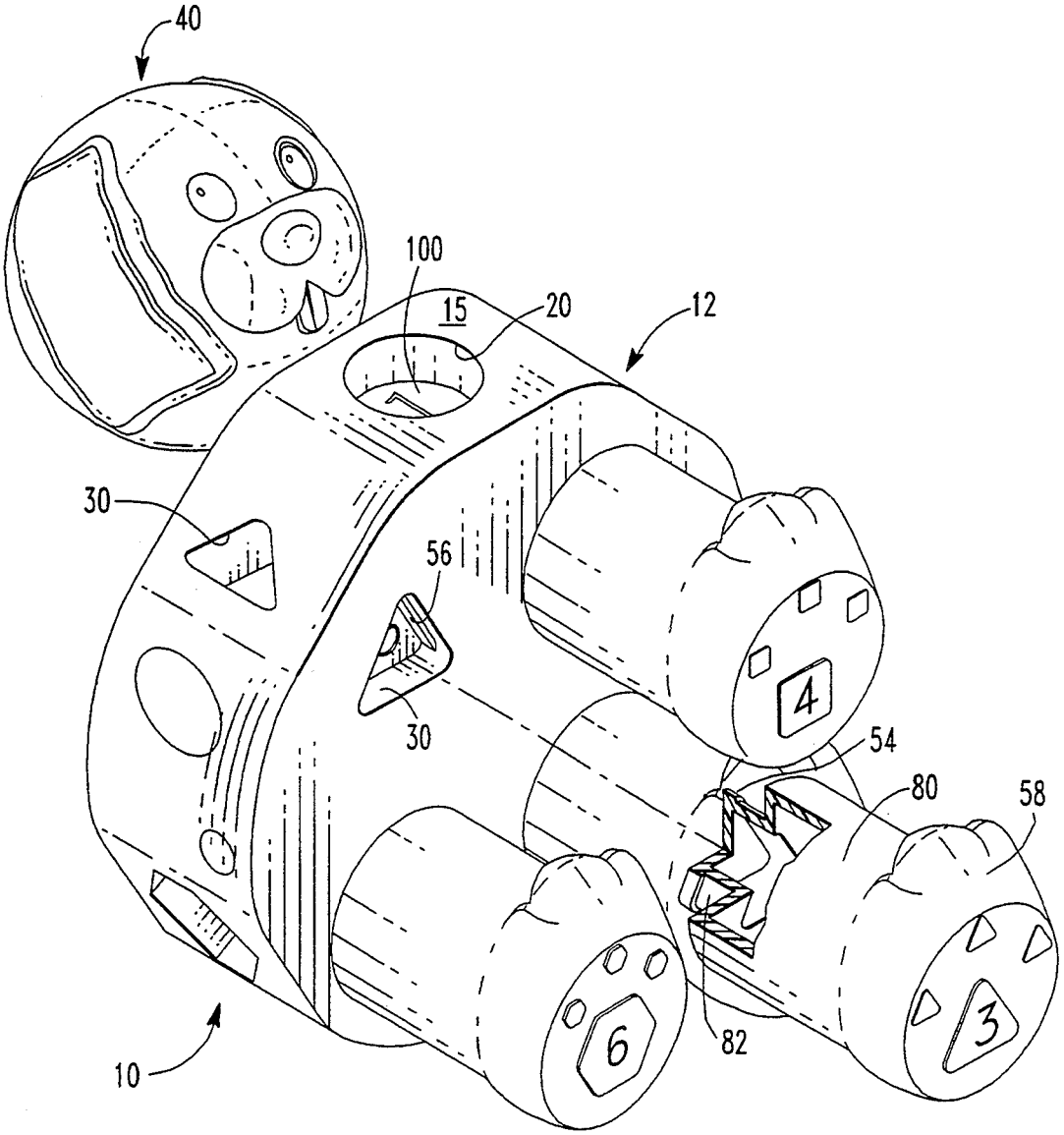
FIG. 27 is a perspective assembly view showing one of the leg members removed from one of its corresponding receptacles.
Figure 28:
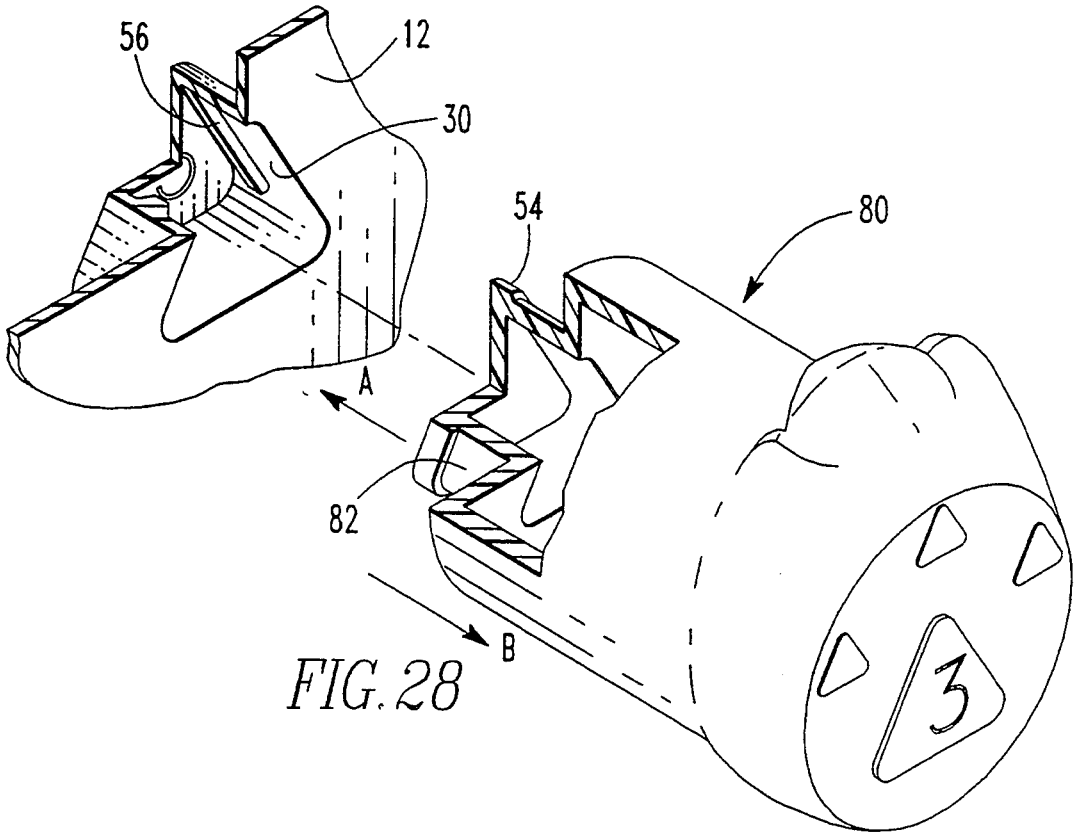
FIG. 28 is an exploded assembly view showing one of the leg members removed from one of its corresponding receptacles.
Figure 29:
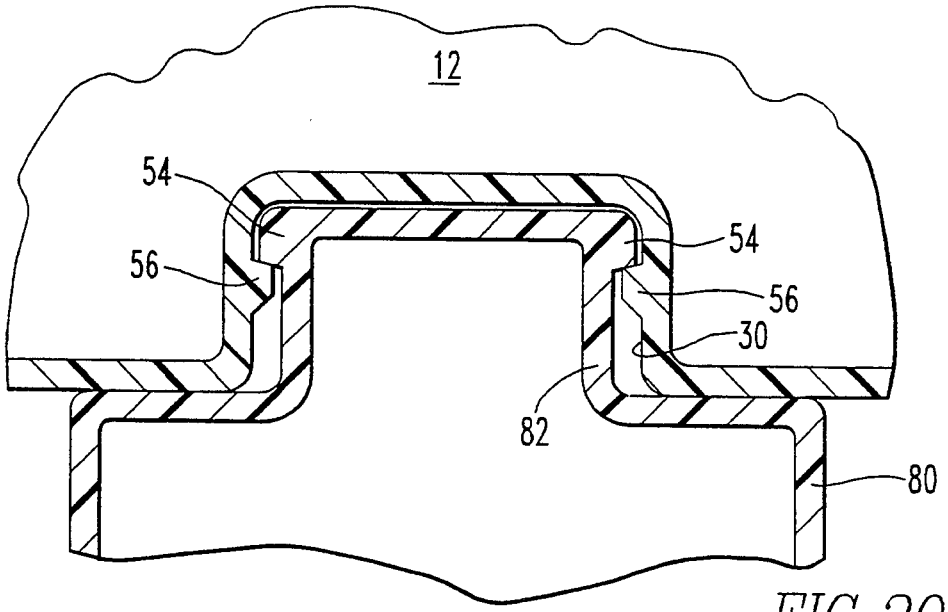
FIG. 29 is a cross-sectional assembly view of one of the leg member and receptacle assemblies of the present invention.

In the preferred embodiment, each of the extended connection members 42, 52, 62, 72, 82, and 92 are equipped with a shoulder member 54 that is adapted to engage at least one, and preferrably two protruding retaining tabs 56 located in each of the correspondingly shaped receptacles to removably retain the corresponding extended member therein. By way of example, FIGS. 27–29 illustrate the method of removably attaching the leg member 80 to the body member 12. It will be appreciated, however, that the head member 40, the leg members 50, 60, and 70 and the tail member 90 are each removably attachable to the body member 12 in a similar manner. As such, as can be seen in FIGS. 27–19, the leg member 80 is attached to the body member 12 by inserting the extended connection member 82 into either of the receptacles 30 in the direction "A" so that the shoulder 54 is forced beyond the tabs 56. It will be appreciated that shoulder 54, in cooperation with tabs 56, serves to removably retain the extended member 82 within the receptacle 30. The leg member 80 may be detached from the body member 12 by pulling the leg member 80 away from the body member 12 in the direction illustrated by the arrow "B" with a sufficient amount of force so as to cause the shoulder member 54 thereof to disengage the tab members 56 provided in receptacle 30. Those of ordinary skill in the art will readily appreciate that the amount of force required to detach the leg 80 from the body member 12 can be varied by varying the amount of engagement provided between the tabs 56 and the shoulder 54 and/or by varying the thickness and or composition of the materials comprising those component parts. It will, of course, be further appreciated that the head member 40, legs 50, 60, 70, and 80, and tail 90 may be removably retained within their corresponding receptacles by a myriad of other acceptable retainer arrangements that permit those appendages to be attached and detached from the body member 12 by a young child.

Figure 14:
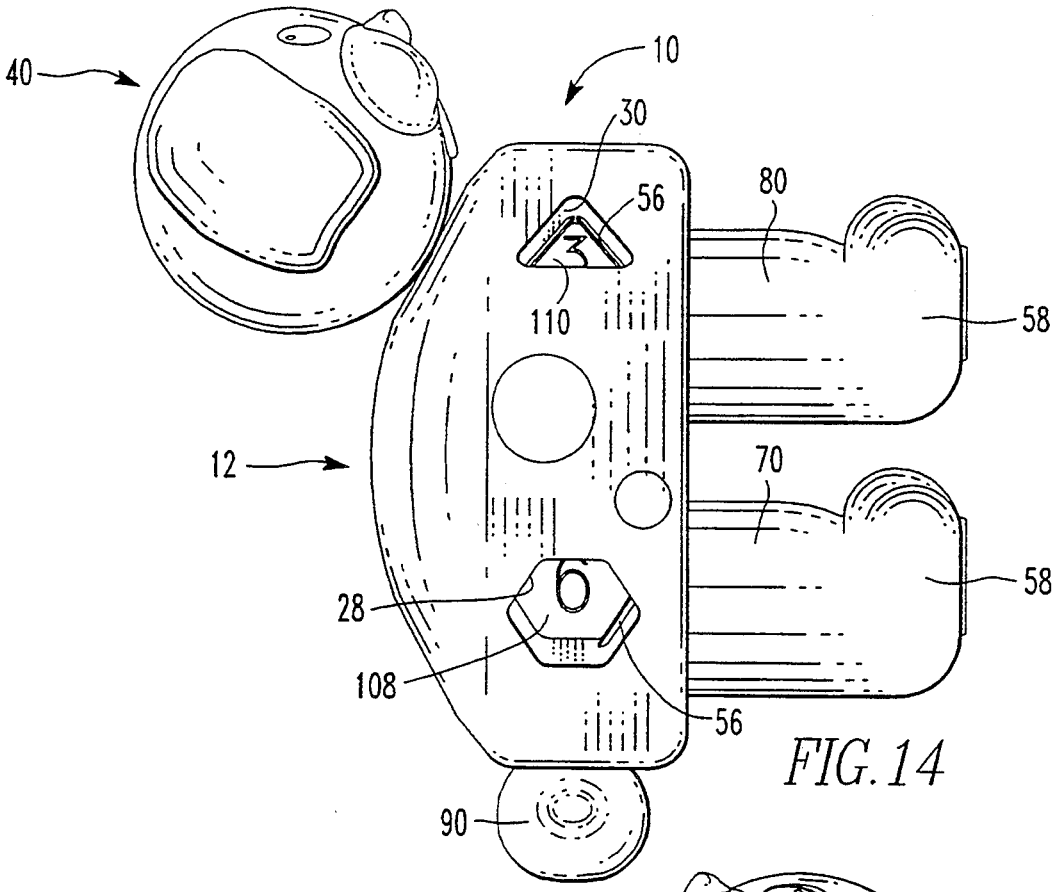
FIG. 14 is a left side elevational view of the toy puppy figure of FIG. 8.
Figure 20:
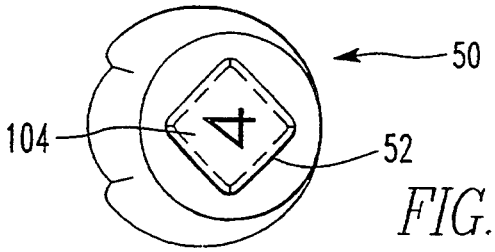
FIG. 20 is a bottom view of the leg member of FIG. 19.
Figure 21:
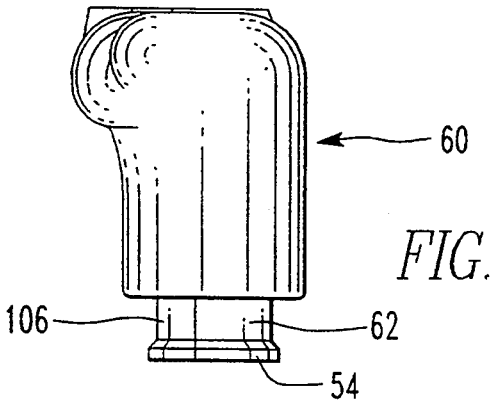
FIG. 21 is a side elevational view of a second leg member of the toy puppy figure of the present invention.
Figure 22:
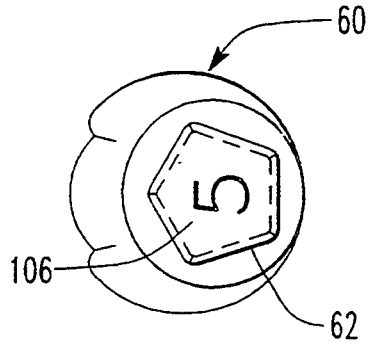
FIG. 22 is a bottom view of the leg member of FIG. 21.

The puppy FIG. 10 of the preferred embodiment is also provided with a number and color matching scheme that is described in detail below. In general, each of the extended members have a different number molded or painted thereto that corresponds to like numbers provided in the receptacles into which they may be inserted. More specifically, the extended member 42 that is attached to the head member 40 preferably has the number 37 1" attached thereto. See FIG. 16. In addition, each of receptacles 20 also has the number "1" attached, molded, or painted to the bottom surface thereof as shown in FIGS. 3 and 8. Likewise, the extended member 92 of the tail member 90 has the number "2" affixed thereto and the each of the corresponding receptacles 22 also has the number "2" applied to the bottom surface thereof. See FIGS. 7, 11, and 18. Also in the preferred embodiment, the extended member 82 of the leg member 80 has the number "3" attached thereto and each of the correspondingly shaped receptacles 30 also has the number "3" attached, painted or molded thereto. See FIGS. 2, 14, and 26. The extended member 52 of the leg 50 has the number "4" attached thereto and each of the square-shaped receptacles 24 also has the number "4" affixed to the bottom thereof as shown in FIGS. 1, 10, and 20. Similarly, the extended member 62 of the leg 60 has the number "5" affixed thereto and each of the correspondingly shaped receptacles 26 also have the number "5" affixed, painted or molded thereto. See FIGS. 1, 13, and 22. Finally, the hexagonal-shaped extended member 72 of the leg 70 has the number "6" affixed thereto and each of the correspondingly shaped hexagonal receptacles 28 also has the number "6" affixed to the bottom thereof. See FIGS. 1, 14, and 24.

Those of ordinary skill in the art will appreciate that the above-described number identification and matching scheme may be varied without departing from the principle and scope of the present invention. For example, the numbers may be affixed to the various extended members or leg members and receptacles in a variety of locations by a myriad of known methods such as by applying number bearing adhesive labels or by painting the numbers onto their respective parts with a non-toxic paint or by molding the numbers into the appropriate components. In addition, the numbering scheme can be varied to suite the number of appendages and/or shapes of the receptacles. Furthermore, the numbering scheme may be replaced by other identification schemes wherein, for example, the above-described numbers would be replaced with Roman numerals, letters or other symbols.

Figure 15:
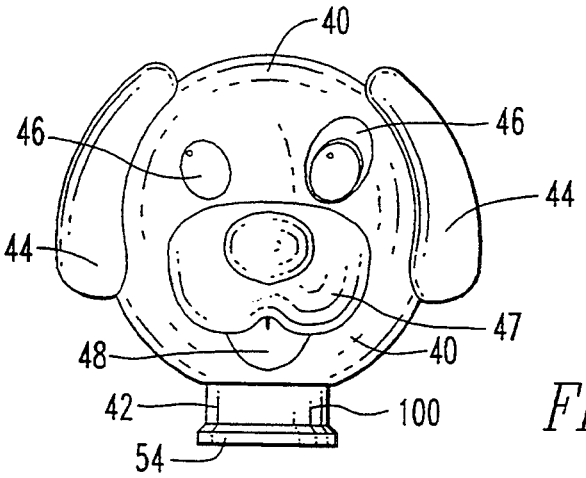
FIG. 15 is a front elevational view of the head member of the toy puppy figure of the present invention.
Figure 16:
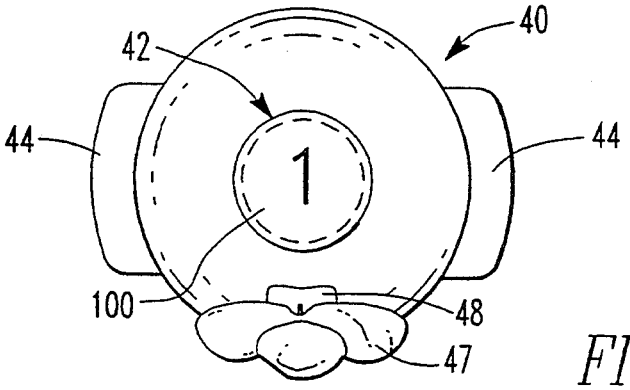
FIG. 16 is a bottom view of the head member of FIG. 15.
Figure 17:
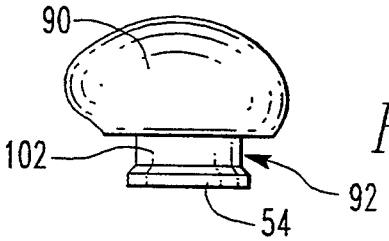
FIG. 17 is a side elevational view of the tail member of the toy puppy of the present invention.
Figure 18:
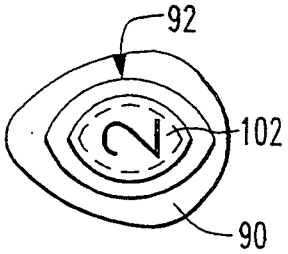
FIG. 18 is a bottom view of the tail member of FIG. 17.

As mentioned above, the preferred embodiment of the present invention may also be provided with a color matching scheme. For example, as shown in FIGS. 15 and 16, the extended member 42 of head member 40 is preferably painted with a non-toxic paint having a color designated as 100. In addition, the bottom portion of the corresponding receptacles 20 are also painted with non-toxic paint having the color 100. See FIGS. 1 and 8. Likewise, the extended member 92 of the tail member 92 and the bottoms of correspondingly shaped receptacles 22 are preferably painted with non-toxic paint having the color designated as 102. See FIGS. 7, 12, 17, and 18. Also in the preferred embodiment, the extended member 52 of the leg member 50 and the correspondingly shaped receptacles 24 are each preferably painted with non-toxic paint having the color designated as 104. See FIGS. 1, 13, 19, and 20. In addition, in its most preferred form, the extended member 62 of the leg 60 and the bottoms of the corresponding receptacles 26 are preferably painted or marked with a non-toxic paint having the color designated as 106. See FIGS. 1, 13, 21, and 22. Also in the preferred embodiment, the extended member 72 of the leg member 70 and the correspondingly shaped receptacles 28 are each marked or painted with a non-toxic paint having the color designated as 108. See FIGS. 1, 14, 23, and 24. Finally, the extended member 82 of leg 80 and the correspondingly shaped receptacles 30 are preferably marked or painted with a non-toxic paint having the color designated as 110. See FIGS. 1, 14, 25, and 26.

The skilled artisan will appreciate that colors 100, 102, 104, 106, 108, and 110 are preferably different from one another to provide a color matching scheme for matching a particular appendage with its corresponding receptacles. It will be further appreciated that each of the receptacles and extended members may be entirely covered with the appropriately colored paint or, in the alternative, only a small portion of each receptacle and/or extended member may be painted. In the preferred embodiment, the above-described colors are applied to the appropriate receptacles and extend members via a non-toxic paint. However, colors 100, 102, 104, 106, 108, and 110 may be applied to the appropriate receptacles and extended members by applying colored adhesive labels thereto or through other known means.

The FIG. 10 of the present invention comprises a puppy and, accordingly, the head member 40 is formed with appropriate ears 44, eyes 46, nose 47, tongue 48. In the preferred embodiment, the ears 44, the nose 47 and the tongue 48 are molded to the head member 40 as is the extended connection member 42. However, the ears 44, eyes 46, nose 47, tongue 48 and any other desirable markings can be painted onto the head member with non-toxic paint. Alternatively, appropriate markings may be applied to the head member 40 via adhesive labels.

As can be seen in FIG. 1, each leg member 50, 60, 70, and 80 has a paw-shaped portion 58 formed on the one end thereof. Preferably each paw-shaped portion 58 is equipped with a shape identifier 61, a number or letter identifier 63, and a color identifier 65 that can be seen when the respective leg member is attached to the body member 12. It will be understood that the shape identifier 61 of each leg member corresponds to the particular shape of the extended member that is attached to that particular leg. Similarly, the number or letter identifier 63 of each leg will also correspond to the specific number that is attached to the extended member of that leg. Likewise, the color identifier 65 of each leg identifies the particular color of the extended member that is attached to that leg. The color identifier 65 is preferably provided by painting the particular shape identifier with the same colored non-toxic paint that covers the extended connection member of that particular appendage. For example, in the preferred embodiment, the extended member of leg 80 has a triangular cross-sectional shape, is blue and has the number "3" attached thereto. The shape identifier 65 located on paw 58 of leg 80 comprises a triangle, the color identifier 65 is blue and the number identifier is "3".

Accordingly, the present invention provides a cuddly playmate for an infant or toddler that has readily repositionable appendages that may assume a variety of different poses while also providing a means by which the child can foster and develop his or her shape, number, and color identification and association abilities. It will be understood, however, that various changes in the details, materials and arrangements of parts which have been herein described and illustrated in order to explain the nature of the invention may be made by those skilled in the art within the principle and scope of the invention as expressed in the appended claims.

We claim:

1. A toy comprising: a body member having a shape generally simulating an animate figure and a plurality of surfaces which are nonplanar with respect to each other;

a plurality of appendages removably connectable to said body member, with at least one said appendage being connectable to at least two said body member surfaces; and means for connecting each of said appendages to said body member, said connecting means comprising an extended member attached to each of said appendages, each said extended member having a cross-sectional shape that is smaller than and of a different cross-sectional shape from the corresponding attached appendage with at least one said extended member having a shape that differs from the shape of at least one other said extended member and a plurality of receptacles in said body member surfaces with at least one receptacle corresponding to each said extended member so that said corresponding extended member may be inserted therein and at least two said receptacles corresponding to at least one said extended member so that the appendage attached thereto can be removably connectable to at least two said body member surfaces.

2. The toy figure of claim 1 further comprising means for removably retaining said extended members in at least one of said receptacles in said body member.

3. The toy figure of claim 2 wherein said retaining means comprises:

at least one retaining tab within each said receptacle in said body member; and a shoulder member on each said extended member adapted to engage said retaining tab in at least one of said receptacles to thereby removably retain said extended member therein.

4. The toy figure of claim 1 wherein each said extended member has a first cross-sectional shape and wherein the cross-sectional shape of at least one said extended member is different from the cross-sectional shape of at least one other said extended member and wherein each said receptacle has a second shape that corresponds to the first cross-sectional shape of the extended member that can be received therein.

5. The toy figure of claim 2 wherein each said appendage has an identifying means attached thereto for identifying the first cross-sectional shape of the extended member that is attached thereto when said extended member is received in one of said receptacles.

6. The toy figure of claim 1 wherein each said extended member has a first numeral indicated thereon, the first numeral on at least one said extended member differing from the first numeral on at least one other said extended member and wherein each said receptacle has a second numeral indicated therein that corresponds to the first numeral on the extended member that is adapted to be received therein.

7. The toy figure of claim 6 wherein each said appendage has numeral identification means attached thereto for identifying the first numeral on the extended member that is attached thereto when said extended member is received in one of said receptacles.

8. The toy figure of claim 1 wherein the cross-sectional shape of at least one said extended member differs from the cross-sectional shape of at least one other extended member and wherein each said extended member has a first numeral indicated thereon, the first numeral on at least one said extended member differing from the first numeral on at least one other said extended member and wherein each said receptacle has a second numeral therein that corresponds to the first numeral of the extended member that is adapted to be received therein.

9. The toy figure of claim 8 wherein each said appendage has a shape and numeral identification means attached thereto for identifying the first cross-sectional shape and the first numeral of the extended member that is attached thereto when said extended member is received in one of said receptacles.

10. The toy figure of claim 1 wherein each said extended member has a first color, the first color of at least one said extended member differing from the first color of at least one other said extended member and wherein each said receptacle has a second color that corresponds to the first color of the extended member that is adapted to be received therein.

11. The toy figure of claim 10 wherein each said appendage has color identification means attached thereto for identifying the color of the extended member that is attached thereto when said extended member is received in one of said receptacles.

12. The toy figure of claim 1 wherein each said extended member has a first cross-sectional shape, the first cross-sectional shape of at least one said extended member differing from the cross-sectional shape of at least one other said extended member and wherein each said extended member has a first numeral indicated thereon, the first numeral on at least one said extended member differing from the first numeral indicated on at least one other said extended member and wherein each said extended member has a first color, the first color on at least one said extended member differing from the first color on at least one other said extended member and wherein each said receptacle has a second shape that corresponds to the first cross-sectional shape of the extended member that is adapted to be received therein and wherein each said receptacle has a second numeral indicated therein that corresponds to the first numeral indicated on the extended member that is adapted to be received therein and wherein each said receptacle further has a second color that corresponds to the first color of the extended member that is adapted to be received therein.

13. The toy figure of claim 12 wherein each said appendage has a shape, numeral, and color identification means attached thereto for identifying the first cross-sectional shape, the first numeral and the first color of the extended member that is attached thereto when said extended member is received in one of said receptacles.

14. The toy figure of claim 12 further comprising means for removably retaining each said extended member within at least one of said receptacles in said body member.

15. The toy figure of claim 14 wherein said retaining means comprises:

at least one retaining tab within each said receptacle in said body member; and a shoulder member on each said extended member adapted to engage said retaining tab in at least one of said receptacles to thereby removably retain said extended member therein.

16. The toy figure of claim 1 wherein said appendages comprise:

a head member;

a first leg member;

a second leg member;

a third leg member;

a fourth leg member; and a tail member.

17. A toy comprising:

a body member having a shape generally simulating an animate figure and a plurality of surfaces which are non-planar with respect to each other;

a plurality of appendages removably connectable to said body member, with at least one said appendage being connectable to at least two said body member surfaces; and means for removably connecting each of said appendages to said body member, said connecting means comprising an extended member attached to each of said appendages, each said extended member having a first cross-sectional shape that is smaller than and of a different cross-sectional shape from the corresponding attached appendage, the first cross-sectional shape of at least one extended member differing from the first cross-sectional shape of at least one other extended member, each said extended member further having a first numeral indicated thereon, the first numeral on at least one other said extended member differing from the first numeral indicated on at least one other said extended member, and a plurality of receptacles in said body member surfaces sized to receive therein at least one of said extended members, and at least two said receptacles corresponding to at least one extended member so that the appendage attached thereto can be removably connectable to at least two said body member surfaces, each said receptacle having a second numeral indicated therein that corresponds to the first numeral of the extended member adapted to be received therein.

18. The toy figure of claim 17 further comprising means for removably retaining said extended members in at least one of said receptacles in said body member.

19. The toy figure of claim 18 wherein said retaining means comprises:

at least one retaining tab within each said receptacle in said body member; and a shoulder member on each said extended member adapted to engage said retaining tab in at least one of said receptacles to thereby removably retain said extended member therein.

20. The toy figure of claim 17 wherein each said appendage has a shape and numeral identification means attached thereto for identifying the first cross-sectional shape and the first numeral of the extended member that is attached thereto when said extended member is received in one of said receptacles.

21. The toy figure of claim 17 wherein each said extended member has a first color, the first color of at least one said extended member differing from the first color of at least one other extended member and wherein each said receptacle has a second color that corresponds to the first color of the extended member that is adapted to be received therein.

22. The toy figure of claim 17 wherein each said appendage has color identification means attached thereto for identifying the color of the extended member that is attached thereto when said extended member is received in one of said receptacles.

23. a toy comprising:

a body member having a shape generally simulating an animate figure;

a plurality of appendages removably connectable to said body member;

means for removably connecting each of said appendages to said body member, said connecting means comprising an extended member attached to each of said appendages, each said extended member having a first cross-sectional shape that is smaller than and of a different cross-sectional shape from the corresponding attached appendage, the first cross-sectional shape of at least one said extended member differing from the first cross-sectional shape of at least one other extended member, each said extended member further having a first numeral indicated thereon, the first numeral on at least one of said extended members differing from the first numeral indicated on at least one other said extended member, each said extended member having a first color, the first color of at least one said extended member differing from the first color of at least one other extended member, and a plurality of receptacles in said body member sized to receive therein at least one of said extended members, each said receptacle having a second numeral indicated therein and a second color that corresponds to the first numeral and first color, respectively of the extended member that is received therein;

means for removably retaining said extended members in at least one of said receptacles in said body member; and shape, numeral, and color identification means attached to each said appendage for identifying the first cross-sectional shape, the first numeral, and the first color respectively of said extended member that is attached thereto when said extended member is received in one of said receptacles.

24. The toy figure of claim 23 wherein said retaining means comprises:

a retaining tab within each said receptacle in said body member; and a shoulder member on each said extended member adapted to engage said retaining tab in at least one of said receptacles to thereby removably retain said extended member therein.

25. The toy figure of claim 23 wherein said appendages comprise:

a head member;

a first leg member;

a second leg member;

a third leg member;

a fourth leg member; and a tail member.

26. A toy comprising:

a body member having a shape generally simulating an animate figure and a plurality of surfaces which are nonplanar with respect to each other;

a plurality of appendages removably connectable to said body member, with at least one said appendage being connectable to at least two said body member surfaces; and means for removably connecting each of said appendages to said body member, said connecting means comprising an extended member attached to each of said appendages, each said extended member having a first cross-sectional shape that is smaller than and of a different cross-sectional shape from the corresponding appendage, the first cross-sectional shape of at least one said extended member differing from the first cross-sectional shape of at least one other extended member, each said extended member further having a first color, the first color of at least one said extended member differing from the first color of at least one other said extended member, and a plurality of receptacles in said body member surfaces sized to receive therein at least one of said extended members and at least two said receptacles corresponding to at least one extended member so that the appendage attached thereto can be removably connectable to at least two said body member surfaces, each said receptacle having a second color that corresponds to the first color of the extended member that is adapted to be received therein.

27. The toy figure of claim 26 further comprising means for removably retaining said extended members in at least one of said receptacles in said body member.

28. The toy figure of claim 27 wherein said retaining means comprises:

at least one retaining tab within each said receptacle in said body member; and a shoulder member on each said extended member adapted to engage said retaining tab in at least one of said receptacles to thereby removably retain said extended member therein.

29. The toy figure of claim 26 wherein each said appendage has a shape and color identification means attached thereto for identifying the first cross-sectional shape and the first color of the extended member that is attached thereto when said extended member is received in one of said receptacles.

30. The toy figure of claim 26 wherein each said extended member has a first numeral indicated thereon, the first numeral on at least one said extended member differing from the first numeral indicated on at least one other extended member and wherein each said receptacle has a second numeral that corresponds to the first numeral of the extended member that is adapted to be received therein.

31. The toy figure of claim 30 wherein each said appendage has a numeral identification means attached thereto for identifying the first numeral indicated on the extended member that is attached thereto when said extended member is received in one of said receptacles.

32. The toy figure of claim 31 wherein said appendages comprise:

a head member;

a first leg member;

a second leg member;

a third leg member;

a fourth leg member; and a tail member.

* * * * *